US008968036B2

(12) United States Patent
Ledgerwood et al.

(10) Patent No.: US 8,968,036 B2
(45) Date of Patent: Mar. 3, 2015

(54) ELECTRICAL CONNECTOR HAVING KEYWAYS WITH ALIGNMENT FEATURES

(71) Applicants: Adam D. Ledgerwood, Geneva, NY (US); Alvah Aldrich, Geneva, NY (US); Jason Oliver, Peachtree City, GA (US)

(72) Inventors: Adam D. Ledgerwood, Geneva, NY (US); Alvah Aldrich, Geneva, NY (US); Jason Oliver, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 50 days.

(21) Appl. No.: 13/803,807

(22) Filed: Mar. 14, 2013

(65) Prior Publication Data

US 2014/0065874 A1 Mar. 6, 2014

Related U.S. Application Data

(60) Provisional application No. 61/697,484, filed on Sep. 6, 2012.

(51) Int. Cl.

| | |
|---|---|
| ***H01R 13/64*** | (2006.01) |
| ***H01R 13/641*** | (2006.01) |
| *H01R 13/622* | (2006.01) |

(52) U.S. Cl.

CPC ..... *H01R 13/641* (2013.01); *H01R 13/622* (2013.01)

USPC ..... 439/677

(58) Field of Classification Search

CPC .... H01R 13/64; H01R 13/642; H01R 13/645; H01R 13/6453; H01R 13/6456; H01R 13/629

USPC ..... 439/680–681, 677–678

See application file for complete search history.

(56) References Cited

U.S. PATENT DOCUMENTS

| | | | | |
|---|---|---|---|---|
| 4,059,324 | A | 11/1977 | Snyder et al. | |
| 6,361,349 | B1 | 3/2002 | Hung | |
| 8,747,166 | B2 * | 6/2014 | Yamada et al. | 439/680 |
| 2006/0257076 | A1 * | 11/2006 | Seeley | 385/60 |
| 2007/0123080 | A1 | 5/2007 | Matsumoto et al. | |
| 2007/0155237 | A1 * | 7/2007 | Cairns et al. | 439/587 |
| 2008/0233773 | A1 | 9/2008 | Meleck | |
| 2012/0258638 | A1 * | 10/2012 | Yamada et al. | 439/752.5 |

* cited by examiner

*Primary Examiner* — Chandrika Prasad

(74) *Attorney, Agent, or Firm* — King & Spalding LLP

(57) ABSTRACT

A high-amperage connector with visual alignment features is described. The connector can comprise a male connector with a male skirt where the male skirt has two keys on an outer surface. At least one of the keys on the outer surface of the male skirt can have an alignment feature. The connector also comprises a female connector with a female skin where the female skirt has two keyways on an inner surface of the female skirt. At least one of the keyways can have a corresponding alignment feature located on the outer surface of the female skirt. The alignment features on the male skirt and the female skirt allow a user to easily align the two connectors before connecting them.

19 Claims, 9 Drawing Sheets

FIG. 3
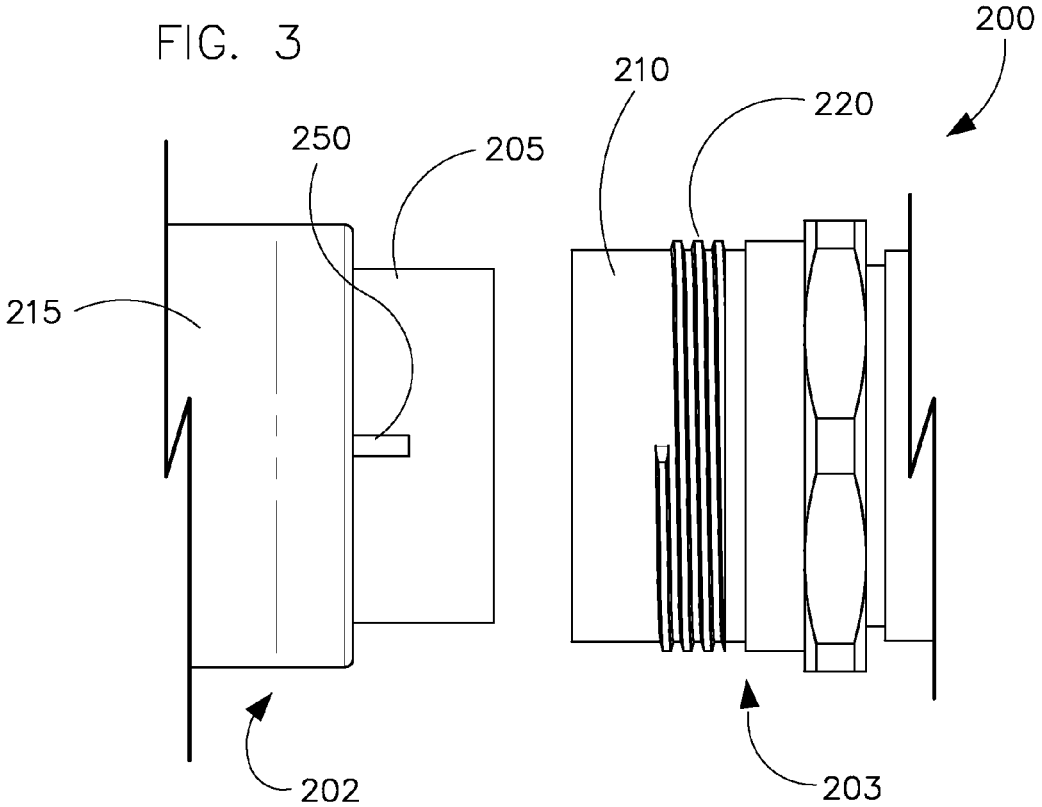
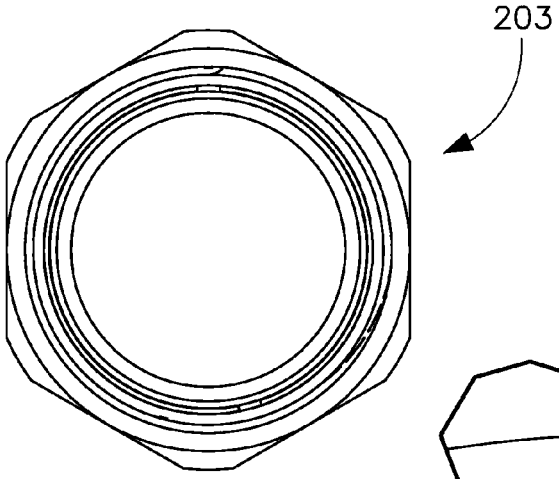
FIG. 4
FIG. 5
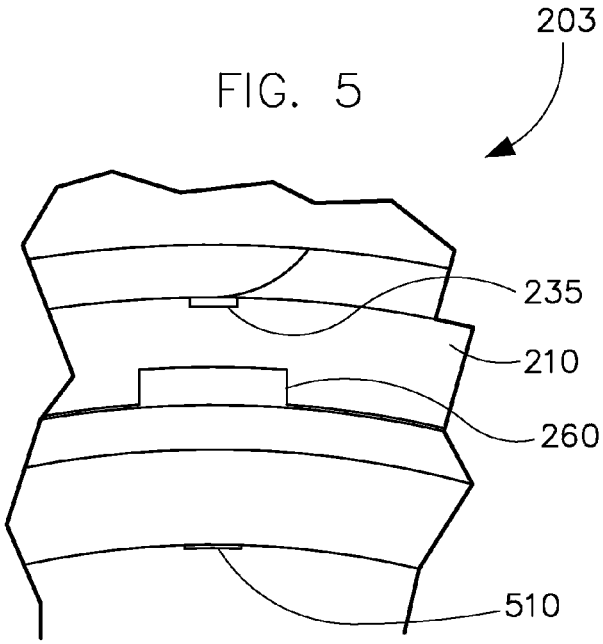

FIG. 13
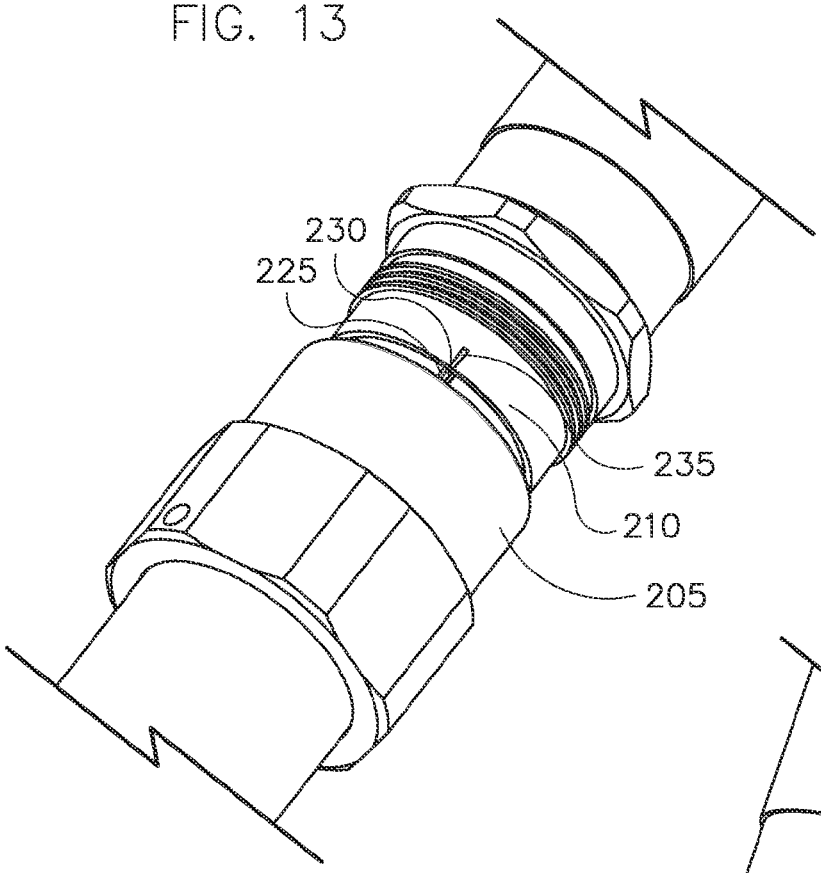
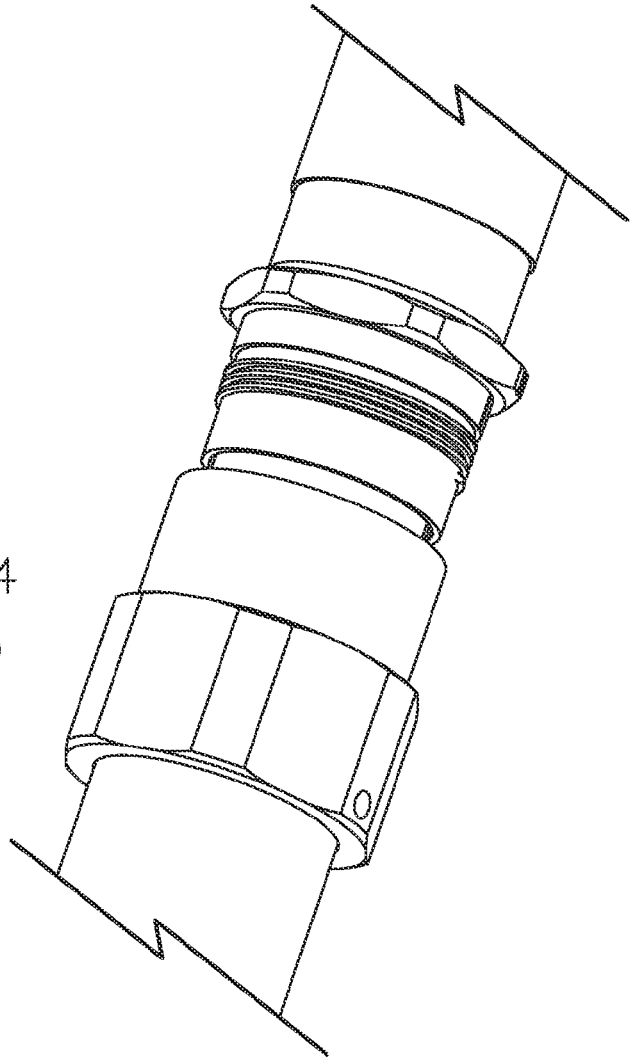
FIG. 14
(Prior Art)

ELECTRICAL CONNECTOR HAVING KEYWAYS WITH ALIGNMENT FEATURES

RELATED APPLICATION

The present application claims priority to U.S. Provisional Patent Application No. 61/697,484, filed Sep. 6, 2012, and titled "Keyway Visual Alignment Feature," the entire content of which is incorporated herein by reference.

TECHNICAL FIELD

The present disclosure relates generally to multi-pin plug and receptacle combinations, and more particularly to systems, methods, and devices for properly aligning a multi-pin plug and receptacle.

BACKGROUND

A variety of industrial and commercial environments require plug and receptacle combinations that conduct relatively large amperage currents. Plugs and receptacles in such commercial and industrial environments can be difficult to connect due to their size and multiple pins. Connecting the plugs and receptacles can be further complicated by the fact that there are often multiple keys and keyways on the connectors. In the past, workers connecting such plugs and receptacles often push them together and twist them until the proper key is aligned with the corresponding keyway. This push and twist approach is used because there is no easily visible means for aligning the plug and receptacle. However, pushing and twisting the plugs and receptacles together can cause damage to the plugs and receptacles when they are misaligned. Accordingly, there is a need for an improved approach to aligning plugs and receptacles so that they can be more easily connected without causing damage to the components.

BRIEF DESCRIPTION OF THE DRAWINGS

Reference will now be made to the accompanying drawings, which are not necessarily drawn to scale, and wherein:

FIGS. 1, 12 and 14 show prior art male and female connectors with no alignment features visible on the exterior of the male and female connectors.

FIGS. 2 and 3 show side views of a pair of male and female connectors comprising an alignment feature in accordance with certain example embodiments.

FIGS. 4 and 5 show front views of a female connector comprising an alignment feature in accordance with certain example embodiments.

FIG. 13 shows a perspective view of a properly aligned male and female connector in accordance with certain example embodiments.

SUMMARY

The present disclosure is directed to high-amperage connectors with visual alignment features. In one embodiment, as connector can comprise a male connector with a male skirt where the male skirt has two keys on an outer surface. At least one of the keys on the outer surface of the male skirt can have an alignment feature. The connector also comprises a female connector with a female skirt where the female skirt has two keyways on an inner surface of the female skirt. At least one of the keyways can have a corresponding keyway alignment feature located on the outer surface of the female skirt. The alignment features on the male skirt and the female skirt allow a user to easily align the two connectors before connecting them.

In another embodiment, a connector can comprise a male connector with a male skirt where the male skirt has at least one key on an outer surface. The connector also comprises a female connector with a female skirt where the female skirt has at least one keyway on an inner surface of the female skirt. The at least one keyway can have a corresponding keyway alignment feature located on the outer surface of the female skirt. The keyway alignment feature on the outer surface of the female skirt allows a user to easily align the key on the male skirt with the keyway on the female skirt.

DETAILED DESCRIPTION OF EXAMPLE EMBODIMENTS

The example embodiments discussed herein are directed to systems, apparatuses, and methods of connecting high-amperage connectors using a keyway visual alignment feature. Embodiments of connectors using a keyway visual alignment feature can take a variety of configurations based on the amperage rating, the conductor size, the size of the plug and receptacle and the arrangement of the conductor pins. Embodiments of connectors using a keyway visual alignment feature may be compliant with one or more industry standards such as those set by Underwriters Laboratory (UL) or the National Electric Code (NEC).

Figure 1:
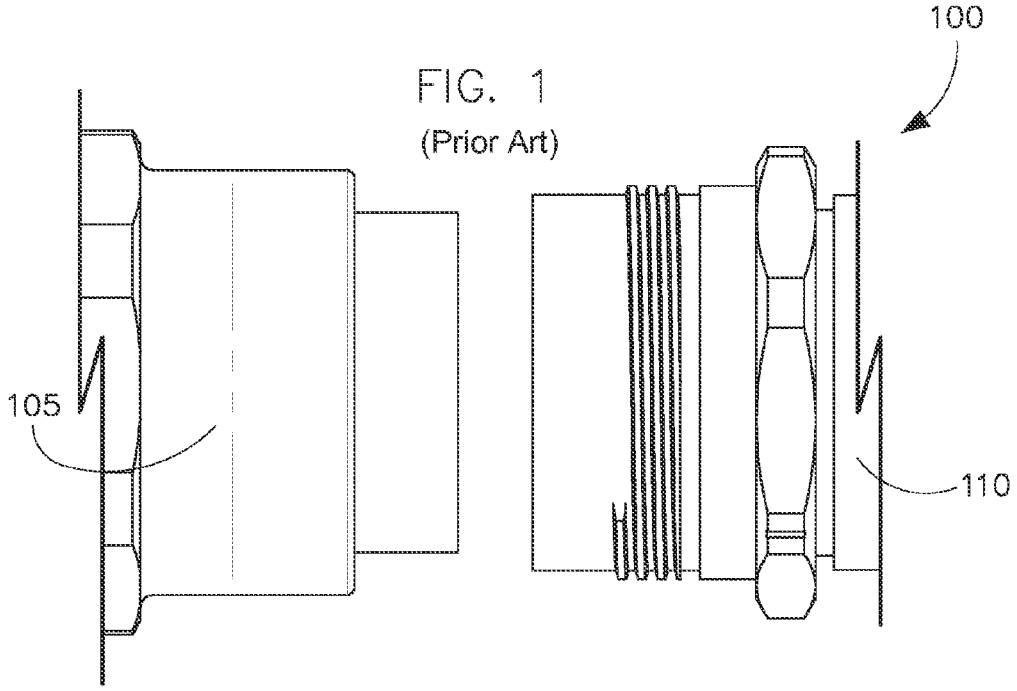
FIG. 1 (Prior Art)
Figure 12:
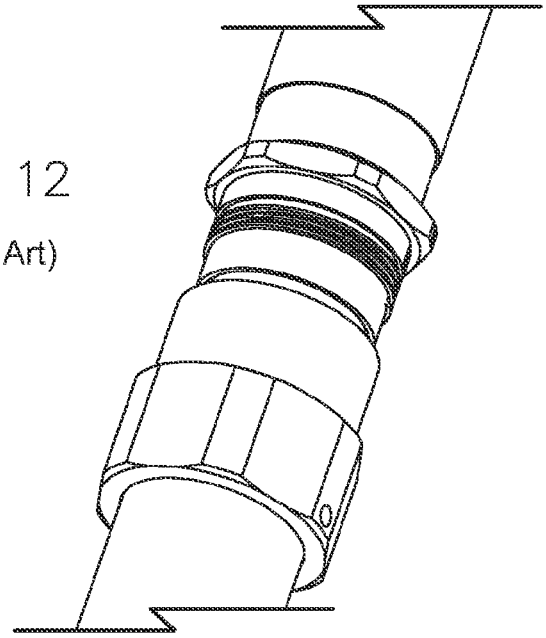
FIG. 12 (Prior Art)

Referring to FIGS. 1, 12 and 14, illustrations are shown of conventional male and female connectors. For example, FIG. 1 shows a connector 100 comprising a male connector 105 and a female connector 110. As shown in these figures, there are no features on the outside of the male and female connectors that allow a person to easily align the connectors. Accordingly, a person must push and twist the male and female connectors together blindly until the correct alignment is achieved.

Figure 2:
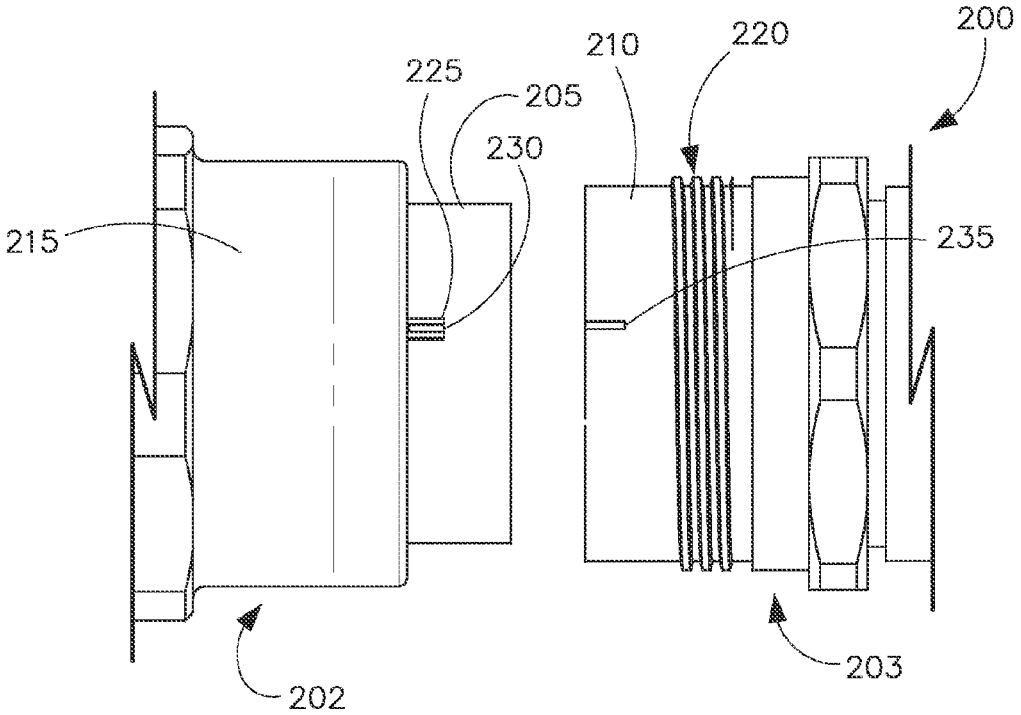

Referring now to FIG. 2, an example male and female portions of a connector are shown in accordance with one embodiment. In the embodiment shown in FIG. 2, the connector 200 comprises a male connector 202, which comprises a coupling nut 215 and as male skirt 205. The female connector 203 comprises threads 220 and female skirt 210. One difference between the male connectors shown in FIG. 1 and FIG. 2 is that the coupling nut 215 in FIG. 2 has a greater range of motion allowing it to be pushed back further to show the key 225 (the 12 o'clock key) on the male skirt 205. When the connectors are properly aligned and connected, the key 225 located on the male skirt 205 must fit within a keyway (not shown in FIG. 2) located on the inside surface of the female skirt 210.

Also shown in the example connector 200 of FIG. 2, key 225 includes an alignment feature 230 in the form of a groove on the key 225. The female skirt 210 includes alignment feature 235 which is also in the form of a groove in this example. When a person attempts to connect the male connector 202 with the female connector 203, the person can align alignment feature 230 and keyway alignment feature 235 as shown in FIG. 2 and in FIG. 13. When the two alignment features 230 and 235 are properly aligned, the key 225 and keyway (not shown in FIG. 2) are also properly aligned.

While the alignment features 230 and 235 are shown as grooves in the example embodiments shown in FIGS. 2 and 13, in alternate embodiments, the alignment features can take a variety of other forms, including but not limited to, a notch, an arrow, a dimple, a pilot hole, a painted mark, or a mark left using a masking technique during an anodizing process. Likewise, in alternate embodiments the alignment features can be located at different axial positions along the male connector and female connector. For example, in the embodiment shown in FIG. 2, keyway alignment feature 235 is located near the leading edge of the female skirt 210. However, in alternate embodiments, such as those described further below in connection with FIGS. 15, 16 and 17, the keyway alignment feature on the female skirt can be positioned further back from the edge of the female skirt 210 closer to the threads 220 or on the other side of the threads (the right side of the threads in FIG. 2).

FIG. 3 shows a view of the same pair of connectors from the opposite side. In the view shown in FIG. 3, the other key 250 (not the 12 o'clock key) is visible on the opposite side of the male skirt 205. The female skirt 210 does not show an alignment feature on the side shown in FIG. 3. The alignment feature on the female skirt 210 is not visible in FIG. 3 because it is located on the opposite side and aligned with the 12 o'clock key as shown in FIG. 2. The single alignment feature on the female skirt, as shown in FIG. 2, allows a person to quickly and easily align the 12 o'clock keyway on the female skirt with the 12 o'clock key on the male skirt.

In an alternate embodiment, a male connector may have only a single key on the outer surface of the male skirt instead of two or more keys. Similarly, the female connector may have only a single keyway located on an inner surface of the female skirt instead of two or more keyways. In such an embodiment, a keyway alignment feature located an the outside surface of the female skirt corresponds with the position of the keyway on the inner surface of the female skirt. The keyway alignment feature located on the outside surface of the female skirt allows for easy alignment of the keyway on the inner surface of the female skirt with the key on the outer surface of the male skirt. In such an embodiment where there is only a single key on the male skirt, it is not necessary to have an alignment feature on the key on the male skirt. The keyway alignment feature of such an embodiment can be helpful where it is not easy to look into the barrel of the female connector in order to align the male key with the female keyway.

Referring to the example embodiment shown in FIGS. 4 and 5, a front view looking down the barrel of the female connector is shown. FIG. 5 is an enlarged view of a portion of FIG. 4. In the enlarged view shown in FIG. 5, the keyway alignment feature 235 is shown in cross-section as a groove along the outside of the female skirt 210. Also visible in FIG. 5 is the keyway 260 located on the inner surface of the female skirt 210. When the male connector and female connector are properly aligned and connected, the key 225 fits into keyway 260. Also shown in FIG. 5 is insert key 510 which allows one to determine if an insert is aligned as described in greater detail in connection with FIGS. 7 and 8.

Figure 6:
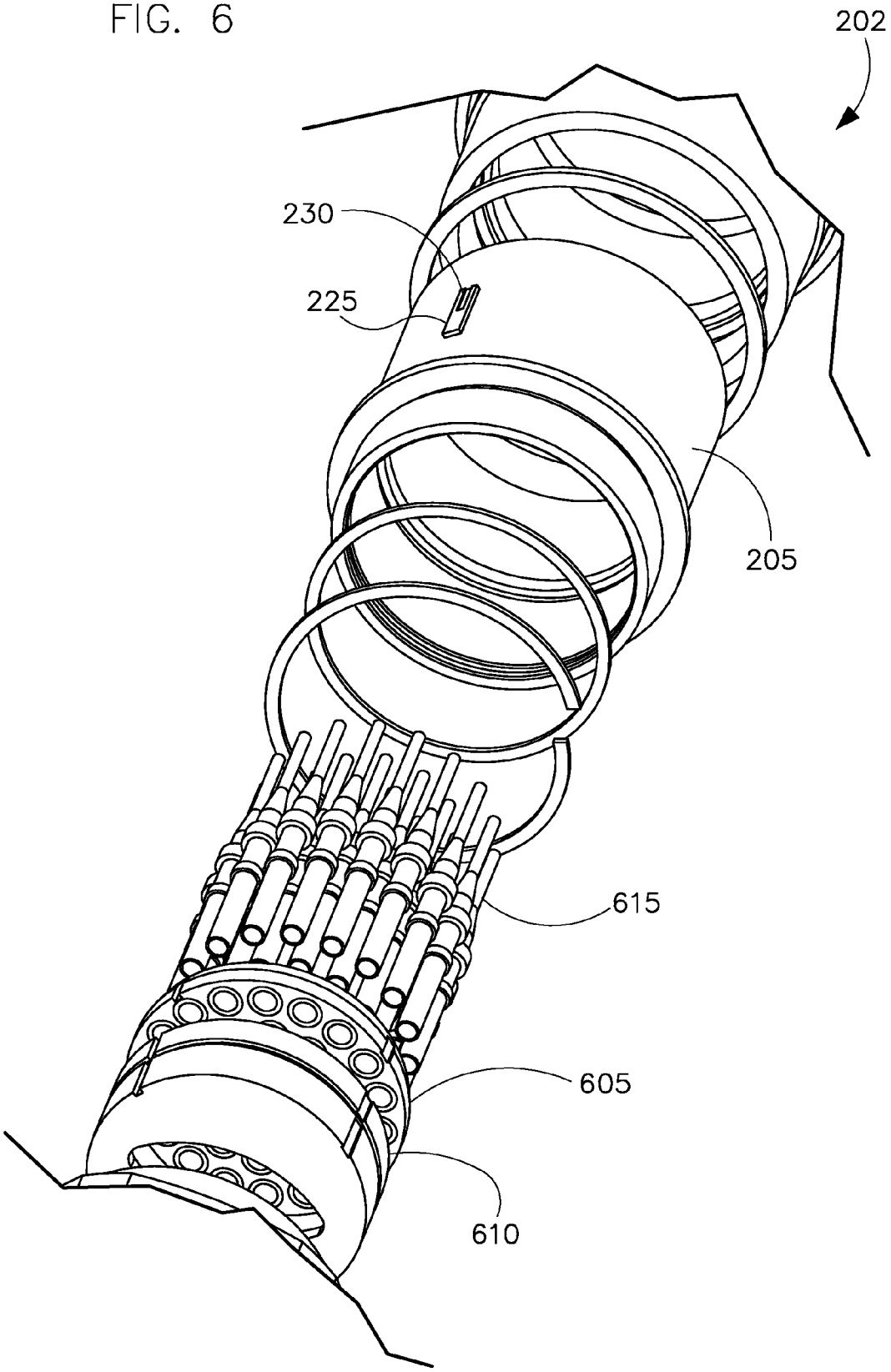
FIG. 6 shows a perspective view of a male connector in accordance with certain example embodiments.

Referring to FIG. 6, an exploded perspective view of the male connector 202 is shown in accordance with an example embodiment. FIG. 6 shows male skirt 205 with male key 225 and male alignment feature 230. Also shown in FIG. 6 are the conductor pins 615, rigid insert 605 and resilient insert 610. When assembled, the conductor pins 615 pass through the apertures in the rigid insert 605 and the resilient insert 610.

Figure 7:
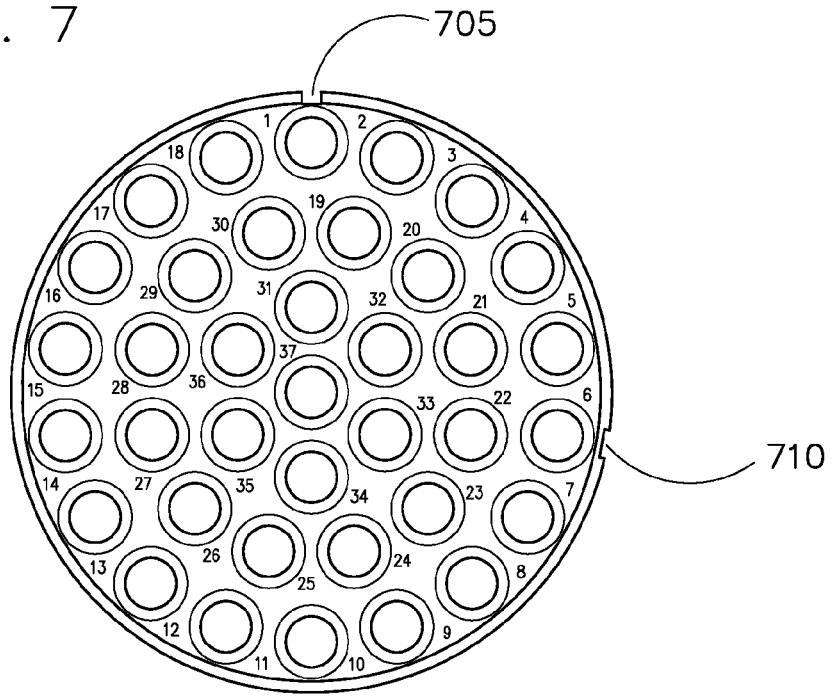
FIG. 7 shows a front view of an insert for as male connector in accordance with certain example embodiments.
Figure 8:
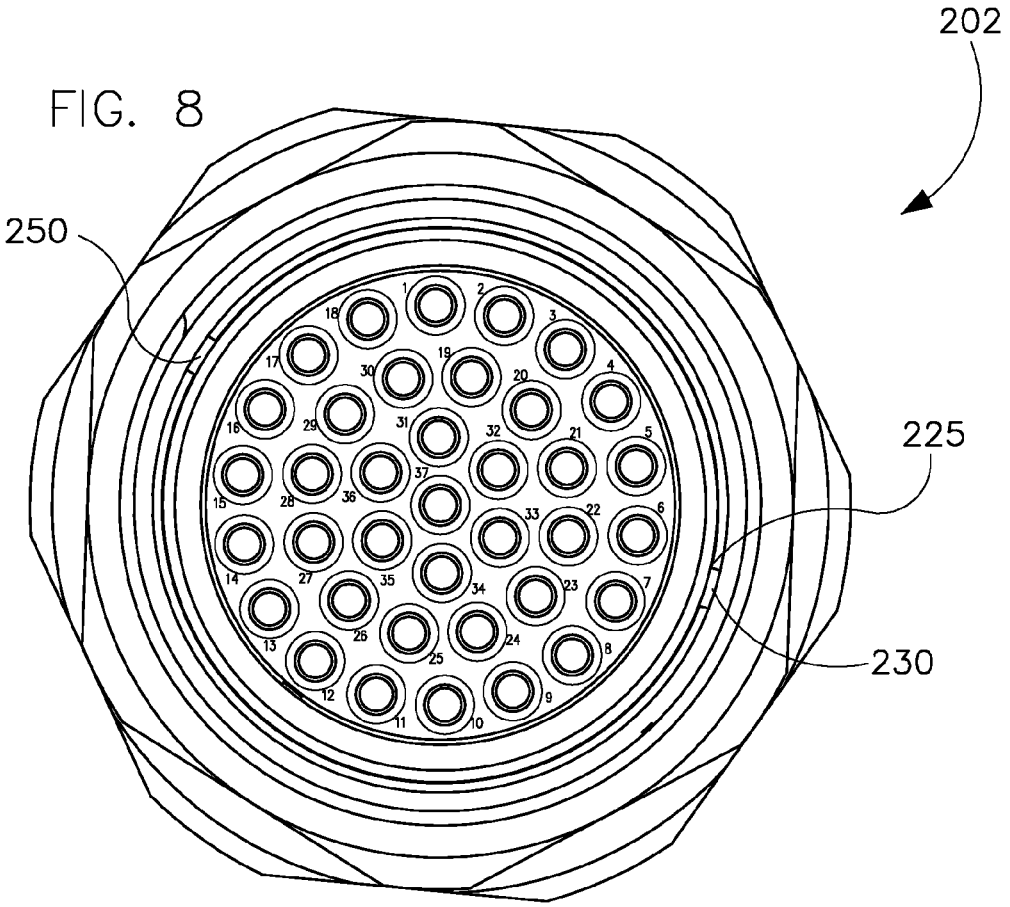
FIG. 8 shows as front view of a male connector with an insert in accordance with certain example embodiments.

As shown in FIG. 7, the rigid insert 605 has a 12 o'clock insert keyway 705 and another insert keyway 710. In alternate embodiments, the rigid insert 605 can comprise more than two insert keyways. An insert key, such as the insert key 510 illustrated in FIG. 5, can be inserted into insert keyway 705 or insert keyway 710. FIG. 8 shows a front view of the assembled male connector 202 with the rigid insert 605 inserted. In the embodiment shown in FIG. 8, the rigid insert 605 has been "reclocked," meaning that it has been rotated from the position shown in FIG. 7. In FIG. 8, the rigid insert 605 has been rotated such that insert keyway 710 (near the number 6 pin) is aligned with the 12 o'clock key 225. As illustrated in FIG. 8, an added benefit of the alignment feature 230 on key 225 is that it permits a person to determine which key is the 12 o'clock key for alignment of an insert.

Figure 9:
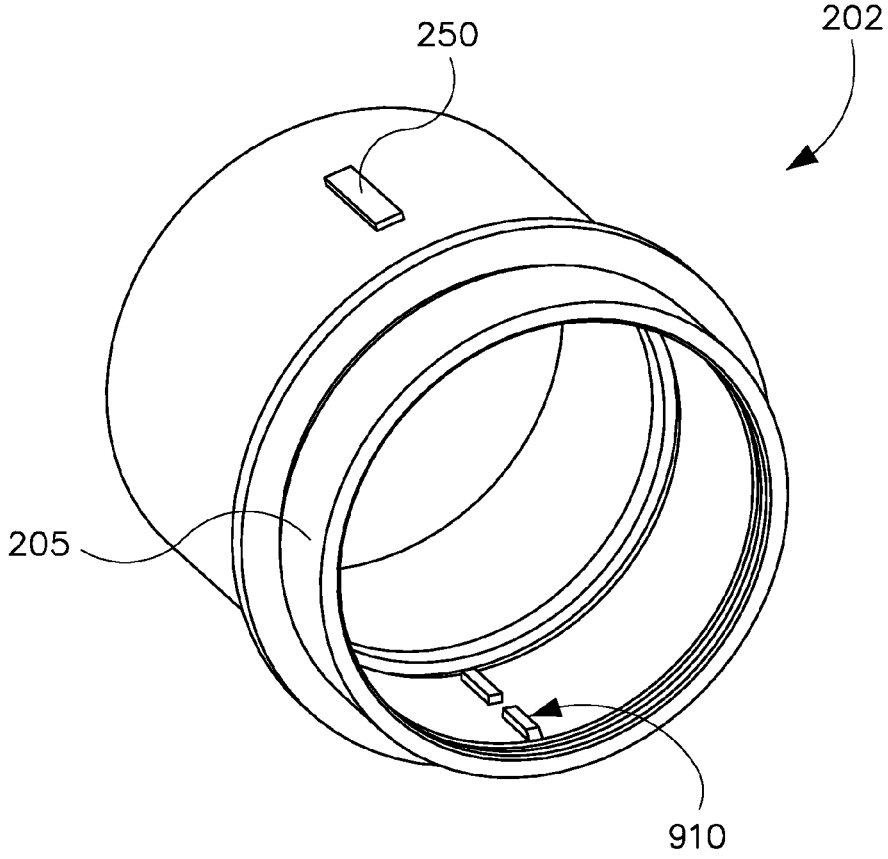
FIG. 9 shows a perspective view of a male connector in accordance with certain example embodiments.
Figure 10:
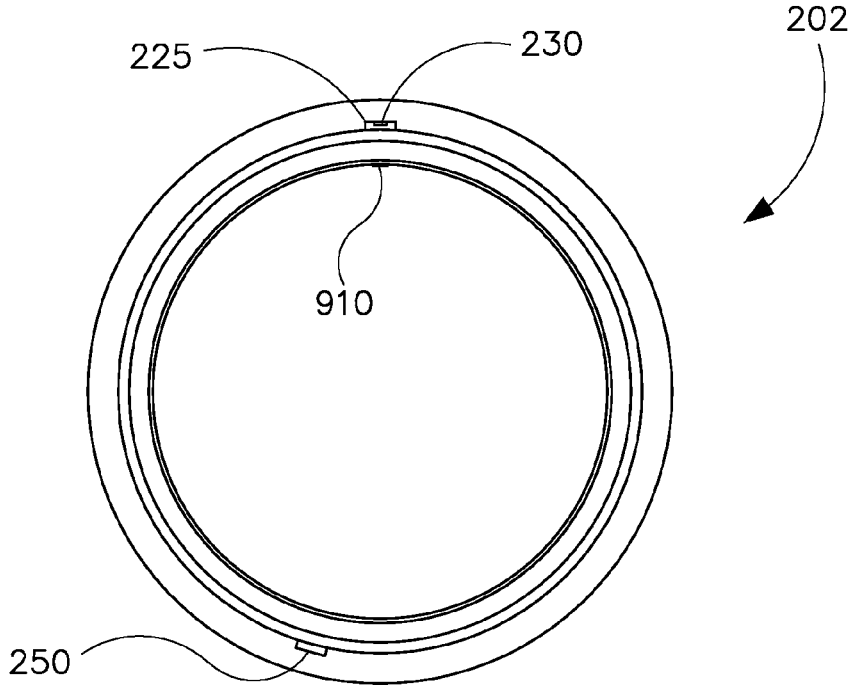
FIGS. 10 and 11 show a front view of a male connector in accordance with certain example embodiments.
Figure 11:
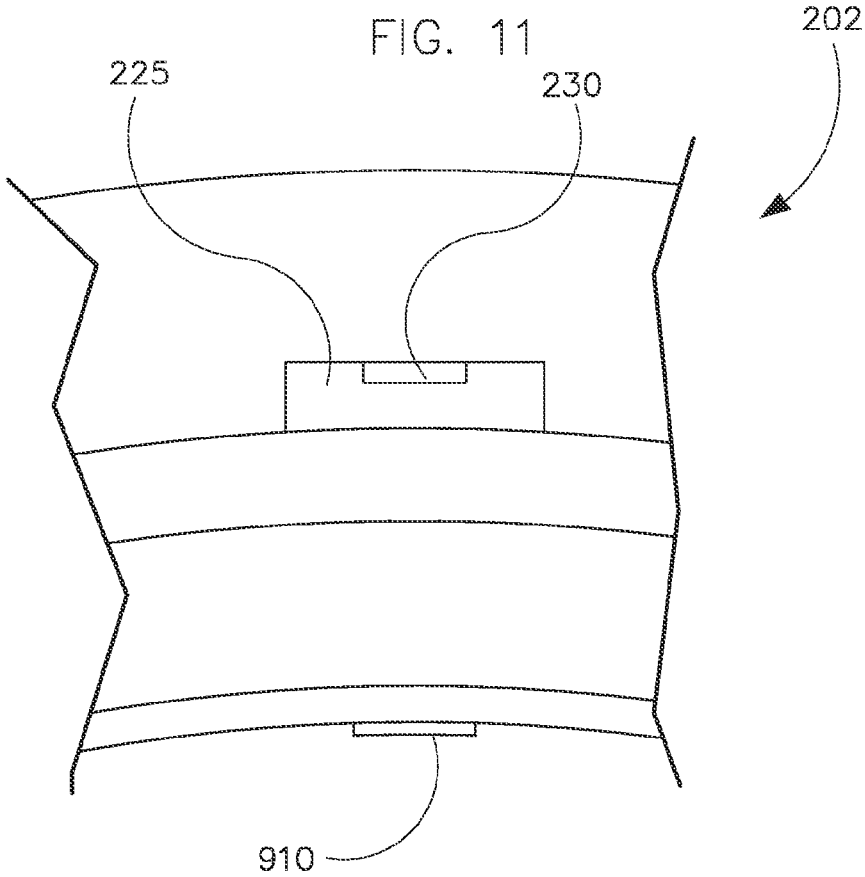

Referring to FIG. 9, a perspective view of male connector 202 is shown in accordance with an example embodiment. The perspective view of male connector 202 shows key 250 on the exterior of male skirt 205 and insert key 910 located on the inside surface of the male skirt 205. As shown in the front cross-sectional view in FIG. 10, the insert key 910 is aligned with key 225. The insert key 910 can be used to align an insert. FIG. 11 is an enlarged view of a portion of FIG. 10 showing insert key 910, key 225 and alignment feature 230.

Figure 15:
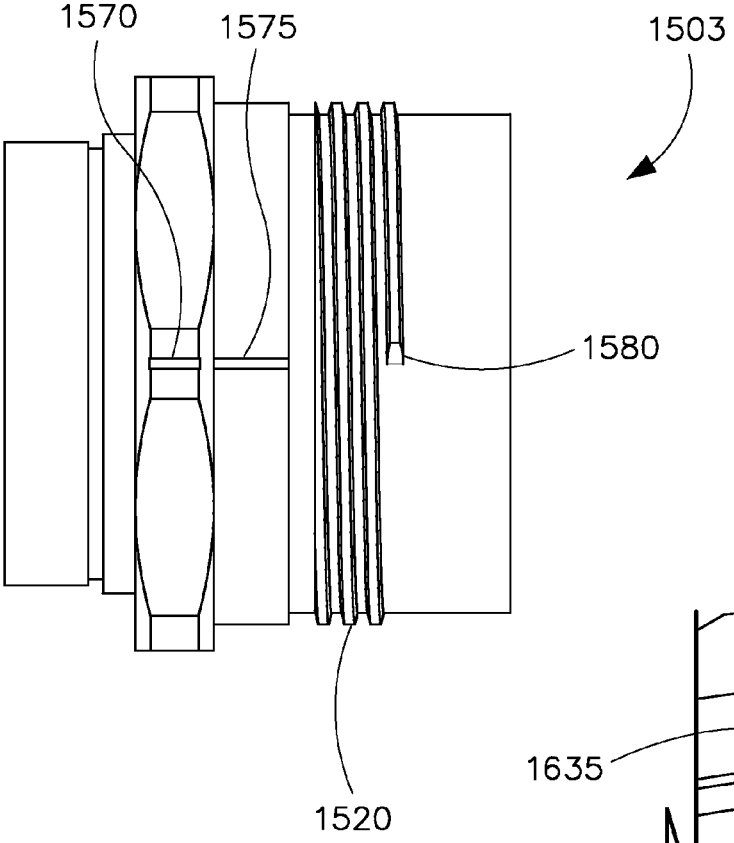
FIGS. 15, 16 and 17 show additional connectors with alignment features located in various positions in accordance with certain example embodiments.
Figure 16:
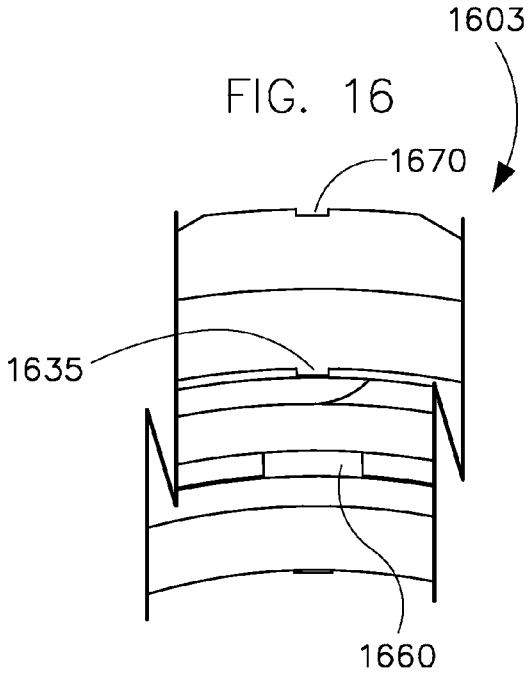
Figure 17:
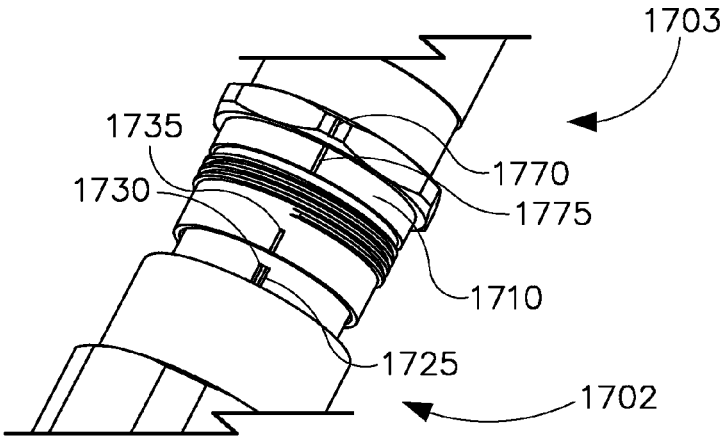

FIGS. 15, 16 and 17 show alternate embodiments where the keyway alignment feature on the female connector is located in different locations. For example, the female connector 1503 in FIG. 15 shows three potential options for locating a keyway alignment feature. Female connector 1503 shows a keyway alignment feature 1570 located on the hex and a keyway alignment feature 1575 located on the collar. An additional keyway alignment feature 1580 is provided by aligning the beginning of the threads 1520 with the keyway (not shown) on the female connector 1503. Keyway alignment feature 1580 is different from keyway alignment features 1570 and 1575 in that keyway alignment feature 1580 is not an additional feature that is machined or applied to the female connector 1503. Each of keyway alignment features 1570, 1575 and 1580 are aligned with the 12 o'clock keyway (not shown) located on the inside surface of the female skirt. In one embodiment, all of keyway alignment features 1570, 1575 and 1580 can be included. In another embodiment, only one or two of keyway alignment features 1570, 1575 and 1580 can be included.

FIG. 16 shows yet another embodiment with keyway alignment features on female connector 1603. In female connector 1603, keyway alignment feature 1635 and keyway alignment feature 1670 are shown aligned with the 12 o'clock keyway 1660 located on the inside surface of the female skirt.

FIG. 17 shows yet another embodiment with keyway alignment features on female connector 1703. In the example shown in FIG. 17, keyway alignment features 1735, 1775 and 1770 are aligned with the 12 o'clock keyway located on the inside surface of the female skirt 1710. Additionally, the beginning of the threads on female connector 1703 are also aligned with the 12 o'clock keyway on the inside surface of the female skirt 1710. As shown in FIG. 17, the keyway alignment features on the female connector 1703 are aligned with the alignment feature 1730 on the key 1725 on the male connector 1702. As illustrated in FIGS. 15, 16, and 17, the components of the connectors, including the skirts, threads, hex and collar can be located in various arrangements in different types of connectors. Consistent with these various arrangements, one or more alignment features can be located at various positions on the outside of the connector to assist the user in aligning the male and female connectors.

Figure 18:
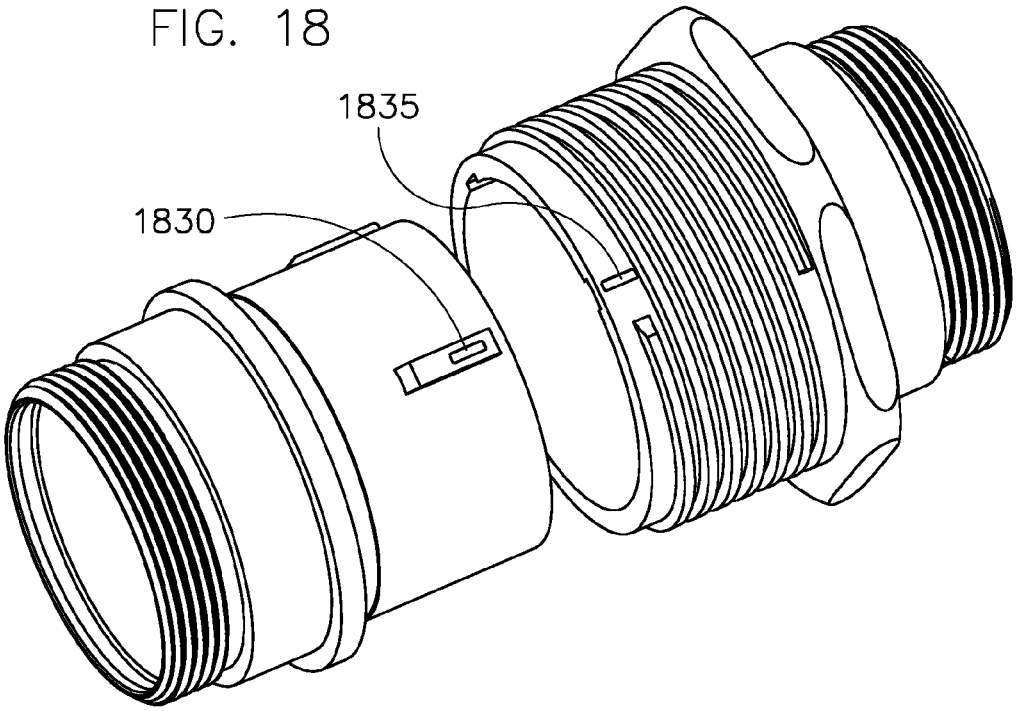
FIGS. 18 and 19 show additional connectors with alignment features far a non-hazardous environment in accordance with certain example embodiments.
Figure 19:
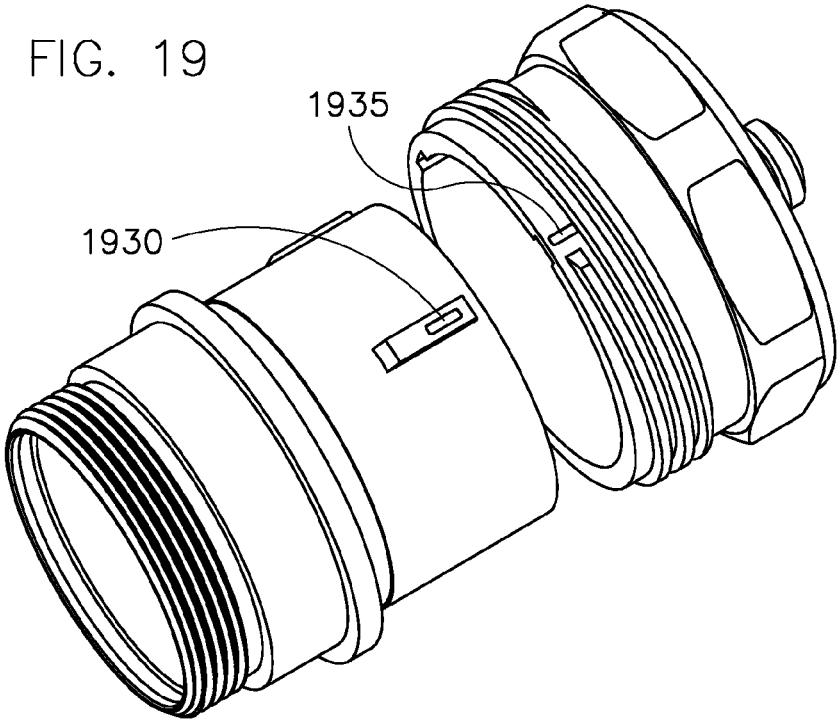

FIGS. 18 and 19 show yet other embodiments of connectors with alignment features. The examples shown in FIGS. 18 and 19 are connectors for non-hazardous environments. As with the previous embodiments, FIGS. 18 and 19 each comprise a male connector with an alignment feature 1830 and 1930 located on a key. FIGS. 18 and 19 also show a female connector with a keyway alignment feature 1835 and 1935. Unlike the hazardous environment connectors shown in previous embodiments, the female connectors of the embodiments shown in FIGS. 18 and 19 have threads relatively close to the leading edge of the female connector. Given the placement of the threads on the female connectors in FIGS. 18 and 19, the keyway alignment features 1835 and 1935 are disposed adjacent to both the threads and the leading edge of the female connector.

Alternate embodiments of electrical connectors can use alignment indicators of different types and in different locations than those shown in the example embodiments described above. Moreover, multiple different types of alignment indicators can be used for connectors having more than two keys.

While the example embodiments of connectors with a keyway visual alignment feature are discussed herein, the principles of the described embodiments can be applied to a variety of types of electrical connectors. Accordingly, many modifications of the embodiments set forth herein will come to mind to one skilled in the art to which pertain having the benefit of the teachings presented in the foregoing descriptions and the associated drawings, many modifications of the embodiments set forth herein will come to the mind of one skilled in the art. Therefore, it is to be understood that keyway visual alignment features for electrical connectors are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. An electrical connector comprising:

a male connector comprising a male skirt, the male skirt comprising at least two keys, the at least two keys disposed on an outer surface of the male skirt, wherein a first key of the at least two keys comprises a first key alignment feature; and a female connector comprising a female skirt, the female skirt comprising at least two keyways disposed on an inner surface of the female skirt, wherein a first keyway of the at least two keyways has a corresponding first keyway alignment feature disposed on an outer surface of the female skirt, wherein the female connector further comprises an insert key disposed on an inner surface of one of the male skirt and the female skirt.

2. The electrical connector of claim 1, wherein the first key is inserted into the first keyway when the male connector and female connector are connected.

3. The electrical connector of claim 1, wherein the first key alignment feature is selected from a group comprising a notch, a groove, an arrow, a dimple, a pilot hole, a painted designation, and a masking mark left after anodizing.

4. The electrical connector of claim 1, wherein the first keyway alignment feature is selected from a group comprising a notch, a groove, an arrow, a dimple, a pilot hole, a painted designation, and a masking mark left after anodizing.

5. The electrical connector of claim 1, wherein the insert key is disposed on the inner surface of the male skirt.

6. The electrical connector of claim 1, wherein the male connector further comprises a coupling nut.

7. The electrical connector of claim 6, wherein the coupling nut is retractable to expose the first key.

8. The electrical connector of claim 1, wherein the first keyway alignment feature is disposed adjacent to a leading edge of the female skirt.

9. The electrical connector of claim 1, wherein the first keyway alignment feature is disposed in a position set back from a leading edge of the female skirt.

10. The electrical connector of claim 1, wherein the first keyway alignment feature is disposed adjacent to a thread on the outer surface of the female skirt.

11. The electrical connector of claim 1, wherein the first keyway alignment feature is disposed on a far side of a thread opposite a side of the thread near the leading edge.

12. The electrical connector of claim 5, wherein the male connector further comprises a rigid insert, the rigid insert comprising an insert keyway.

13. The electrical connector of claim 12, wherein the insert keyway of the rigid insert aligns with the insert key on the inner surface of the male skirt when the male connector is properly assembled.

14. The electrical connector of claim 12, wherein the insert keyway aligns with the first key alignment feature when the male connector is properly assembled.

15. The electrical connector of claim 1, wherein the female connector has a second keyway alignment feature disposed on the outer surface of the female skirt.

16. The electrical connector of claim 1, wherein the first keyway alignment feature is a beginning of a thread on the female connector.

17. The electrical connector of claim 1, wherein the first keyway alignment feature is disposed on a collar on the female connector.

18. The electrical connector of claim 1, wherein the first keyway alignment feature is disposed on a nut on the female connector.

19. An electrical connector comprising:

a male connector comprising a male skirt, the male skirt comprising at least one key, the at least one key disposed on an outer surface of the male skirt; and a female connector comprising a female skirt, the female skirt comprising at least one keyway disposed on an inner surface of the female skirt, wherein the at least one keyway has a single corresponding keyway alignment feature disposed on an outer surface of the female skirt, wherein the female connector further comprises an insert key disposed on an inner surface of one of the male skirt and the female skirt.

* * * * *